US007543818B2

(12) United States Patent
Borg

(10) Patent No.: US 7,543,818 B2
(45) Date of Patent: Jun. 9, 2009

(54) TILTING PROJECTILE GAME

(76) Inventor: Chris Alan Borg, 720 14th St., Huntington Beach, CA (US) 92648

( * ) Notice: Subject to any disclaimer, the term of this patent is extended or adjusted under 35 U.S.C. 154(b) by 488 days.

(21) Appl. No.: 11/354,649

(22) Filed: Feb. 16, 2006

(65) Prior Publication Data

US 2007/0187887 A1 Aug. 16, 2007

(51) Int. Cl.
*A63F 7/00* (2006.01)

(52) U.S. Cl. ..... 273/110; 273/118 R; 273/123 R

(58) Field of Classification Search ..... 273/108–110, 273/113, 115, 116, 118 R, 123 R
See application file for complete search history.

(56) References Cited

U.S. PATENT DOCUMENTS 1,768,016 A * 6/1930 Walker ..... 273/116
3,188,087 A * 6/1965 Larson, Jr. ..... 273/115
3,479,033 A * 11/1969 Crisafulli et al. ..... 273/113
3,787,055 A * 1/1974 Kraemer ..... 273/110
3,879,039 A * 4/1975 Holden ..... 273/110
3,967,824 A * 7/1976 Lund ..... 273/110
4,055,341 A * 10/1977 Martinez ..... 463/69
4,257,600 A * 3/1981 Goldfarb ..... 273/110
5,435,555 A * 7/1995 Fuhrer et al. ..... 273/110
5,749,575 A * 5/1998 German ..... 273/113
2002/0008354 A1* 1/2002 Lorenz et al. ..... 273/119 R
2007/0187887 A1* 8/2007 Borg ..... 273/109

* cited by examiner

*Primary Examiner*—Raleigh W. Chiu

(57) ABSTRACT

A tilting projectile game that can be played by 1 to 4 people and consists of a base, 4 paddles, 4 paddle tilting assemblies and a spherical projectile. The paddle tilting assemblies connect the paddles to the base in a closely grouped 2×2 array and enable each paddle to be individually tilted in any direction while preventing the paddles from touching each other. Each paddle has one or more holes, which are large enough for the projectile to pass through, and the base is shaped to channel the spherical projectile into retrieval areas at the ends of the base after the projectile has fallen below the paddles. A control knob attached to each paddle is used to maneuver the paddle and control the motion of the projectile and can cause the projectile to roll or jump from one paddle to another.

5 Claims, 10 Drawing Sheets

TILTING PROJECTILE GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to games having one or more movable playing surfaces and a spherical projectile. Previous games in this classification generally require the inclusion of some form of internal linkage between the device the player holds and the moveable playing surface. They also generally require an external housing around the playing surfaces. This invention's unique design eliminates the need for those components and by so doing creates a game which offers much greater maneuverability of the moving playing surfaces and control over the velocity of the projectile. It also results in a more robust structure of the game apparatus.

BRIEF SUMMARY OF THE INVENTION

A tilting projectile game that can be played by 1 to 4 people and consists of a spherical projectile, 4 rectangular paddles, 4 paddle tilting assemblies and a base. The paddle tilting assemblies connect the paddles to the base in a rectangular, 2×2 array, with a narrow gap between the interior edges of the paddles. The paddle tilting assemblies enable each paddle to be individually tilted in any direction while preventing the paddles from touching each other. Rails on the outer edges of the paddles form a rail along the perimeter of the 2×2 paddle array that is used both to control the movement of the spherical projectile and to prevent the projectile from falling off the outer edges of the paddles. A control knob attached to the outer side of each paddle's rail is used to maneuver the paddle. Each paddle has one or more holes, which are large enough for the projectile to pass through, and the base is shaped to channel the spherical projectile into retrieval areas at the ends of the base after the projectile has fallen below the paddles. Each player holds the control knob of one or two paddles and by raising, lowering and/or turning the control knobs they can control the motion of the paddle and the projectile when it is on their paddles and cause it to roll or jump from one paddle to another. The object of the game is for opposing players to cause the projectile to drop under their opponent's paddle, either by having the projectile drop through a hole in the opponent's paddle or pass under an edge of the opponent's paddle. A player wins when that goal is accomplished a given number of times.

DETAILED DESCRIPTION OF THE INVENTION

Figure 1:
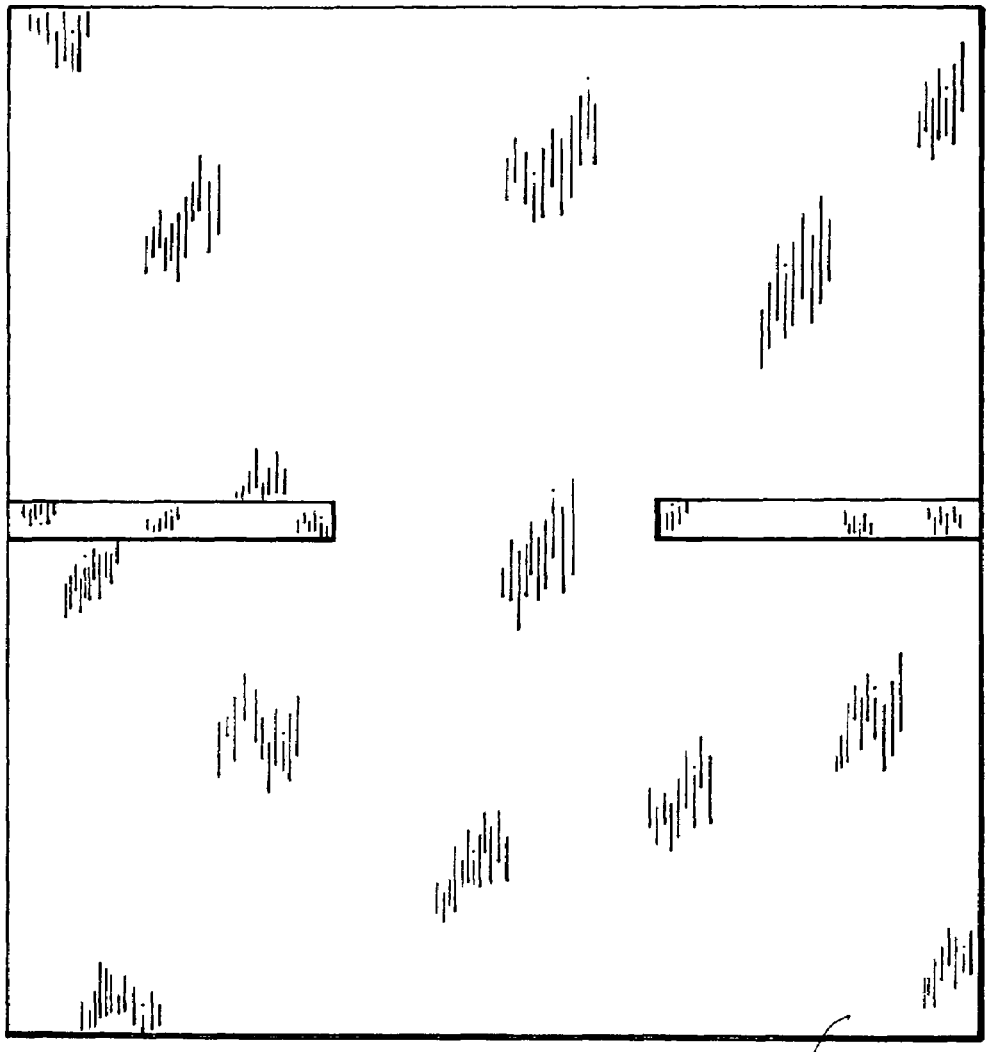
FIG. 1 is a top view of the base which is rectangular in shape with a flat bottom. The upper surface of the base is also flat except for 2 supports located along the latitudinal centerline of the base as shown.
Figure 2:
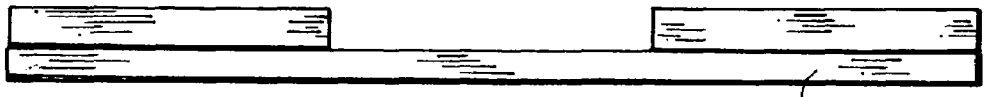
FIG. 2 is an end view of FIG. 1.
Figure 3:
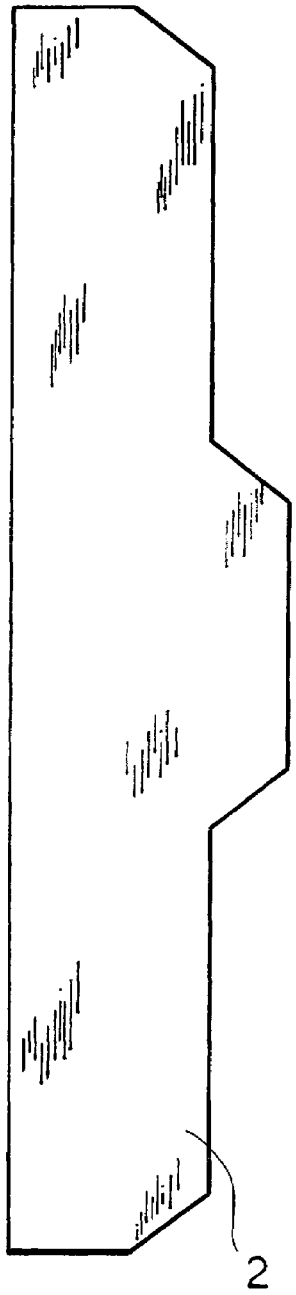
FIG. 3 is a front view of a base side rail. There are 2 of these base side rails.
Figure 4:
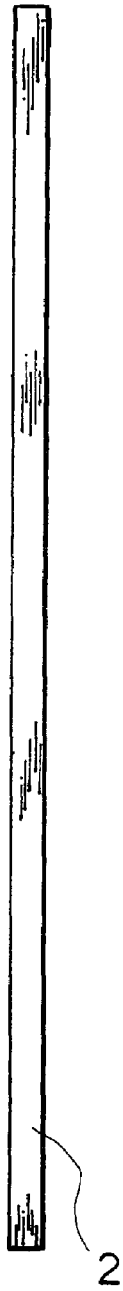
FIG. 4 is a bottom view of FIG. 3.
Figure 5:
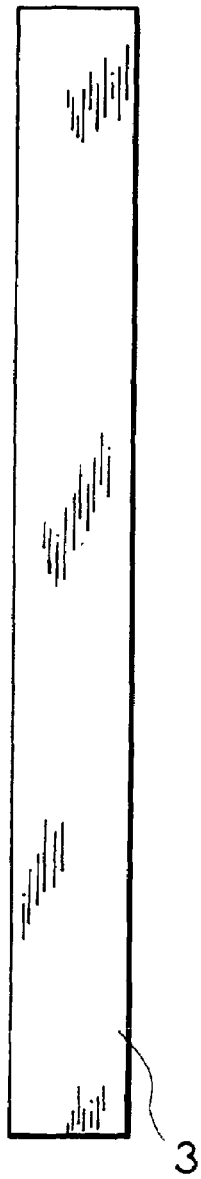
FIG. 5 is a front view of a base end rail. There are 2 of these base end rails.
Figure 6:
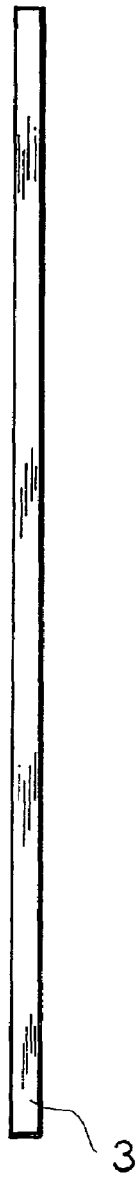
FIG. 6 is a bottom view of FIG. 5.
Figure 7:
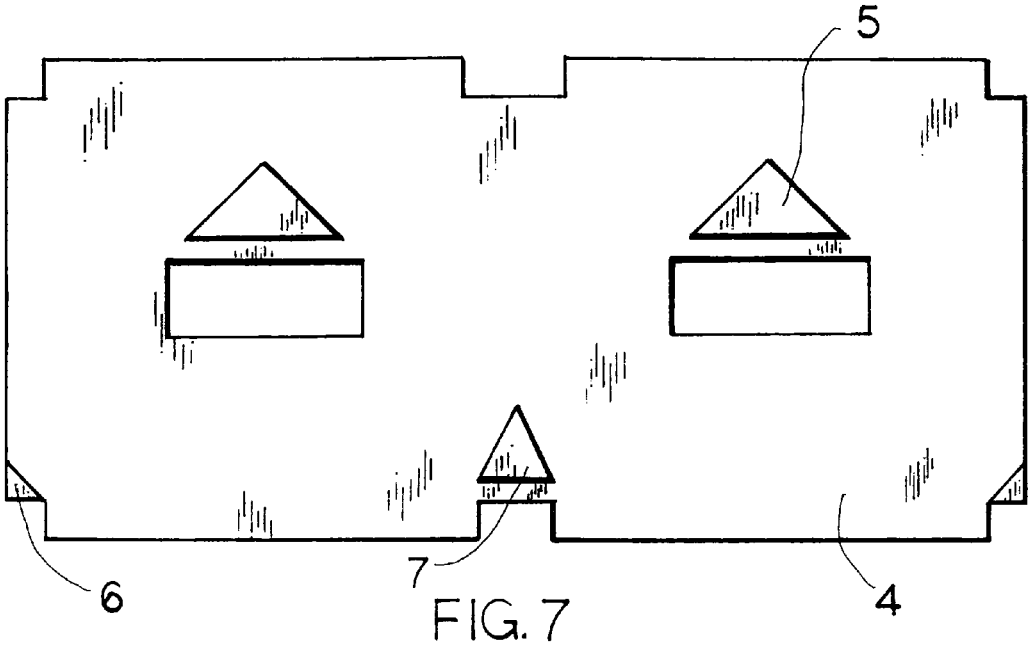
FIG. 7 is a top view of a base ramp which is rectangular in shape with a flat bottom. The upper surface of the base ramp is also flat except for 5 triangular shaped bumpers and 2 rectangular openings as shown. There are 2 base ramps.
Figure 8:
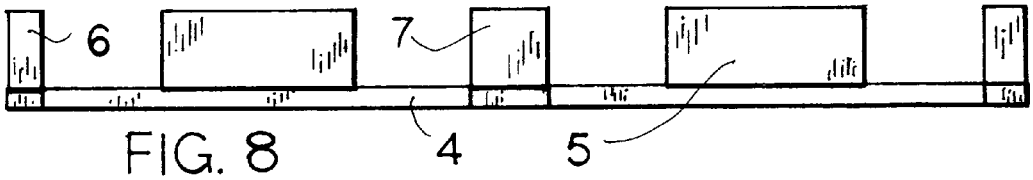
FIG. 8 is an end view of FIG. 7.
Figure 9:
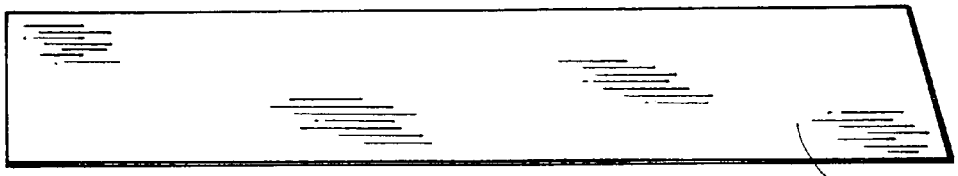
FIG. 9 is a front view of a paddle rail. There are a total of 8 of these paddle rails.
Figure 10:
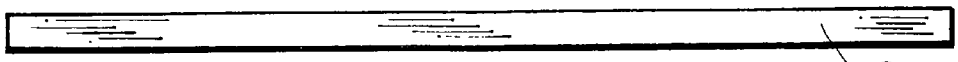
FIG. 10 is a bottom view of FIG. 9.
Figure 11:
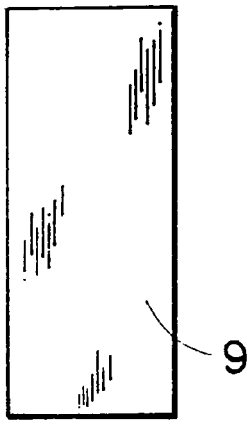
FIG. 11 is a back view of a base middle stop. There are a total of 4 of these middle stops.
Figure 12:
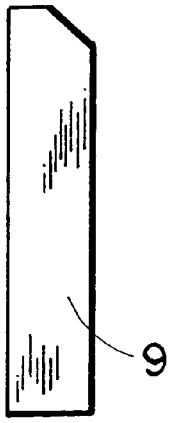
FIG. 12 is a side view of FIG. 11.
Figure 13:
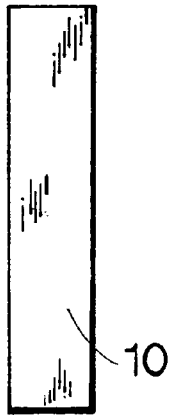
FIG. 13 is a back view of a base corner stop. There are a total of 4 of these corner stops.
Figure 14:
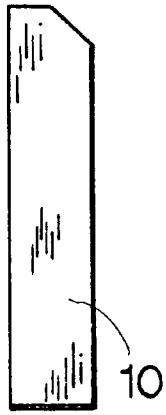
FIG. 14 is a side view of FIG. 13.
Figure 15:
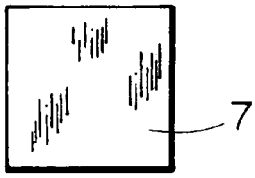
FIG. 15 is a back view of a rear bumper. There are 2 of these rear bumpers.
Figure 16:
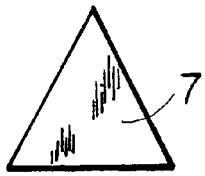
FIG. 16 is a top view of FIG. 15.
Figure 17:
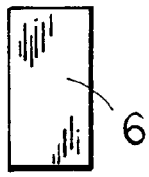
FIG. 17 is a back view of a corner bumper. There are a total of 4 of these corner bumpers.
Figure 18:
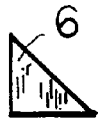
FIG. 18 is a top view of FIG. 17.
Figure 19:
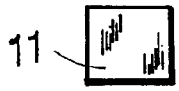
FIG. 19 is a back view of a paddle rail curve. There are a total of 4 of these paddle rail curves.
Figure 21:
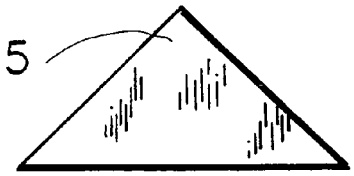
FIG. 21 is a top view of a center bumper. There are a total of 4 of these center bumpers.
Figure 22:
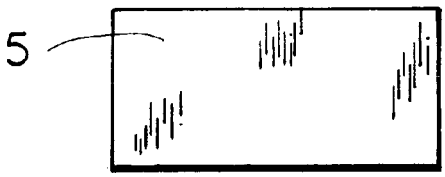
FIG. 22 is a back view of FIG. 21.
Figure 20:
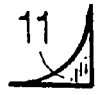
FIG. 20 is a top view of FIG. 19.
Figure 23:
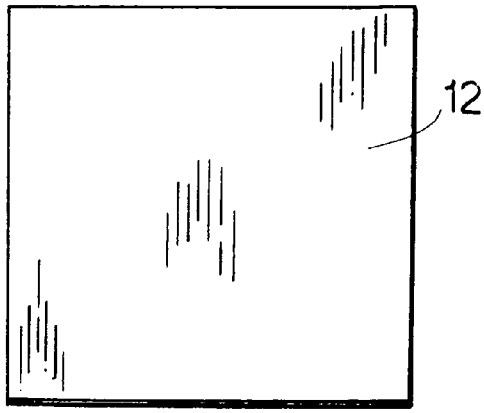
FIG. 23 is a front view of a paddle tilting assembly support. There are a total of 4 of these paddle supports.
Figure 24:
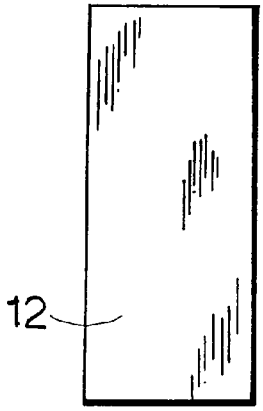
FIG. 24 is a side view of FIG. 23.
Figure 25:
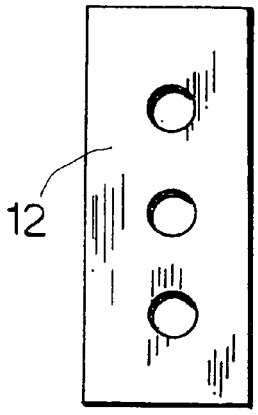
FIG. 25 is a top view of FIG. 23 and FIG. 24 showing the 3 vertical holes that extend through the paddle tilting assembly support.
Figure 26:
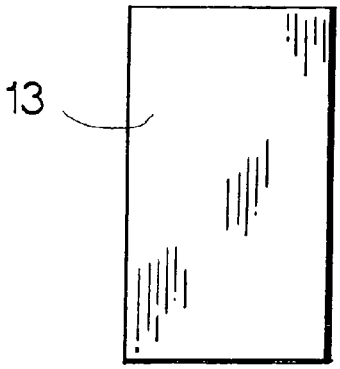
FIG. 26 is a front view of a base center stop.
Figure 27:
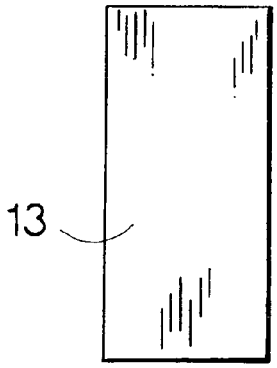
FIG. 27 is a side view of FIG. 26.
Figure 28:
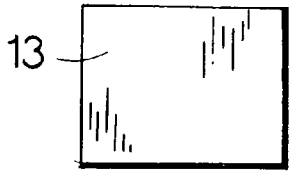
FIG. 28 is a top view of FIG. 26 and FIG. 27.
Figure 29:
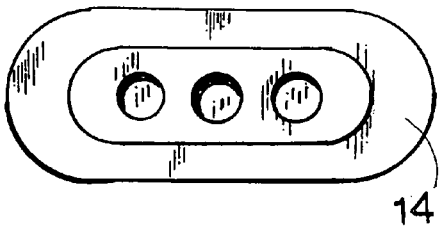
FIG. 29 is a top view of a paddle tilting assembly pad showing its 3 spherical sockets.
Figure 30:
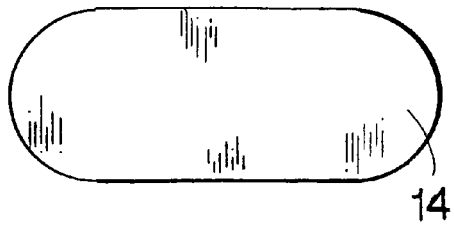
FIG. 30 is a bottom view of FIG. 29.
Figure 32:
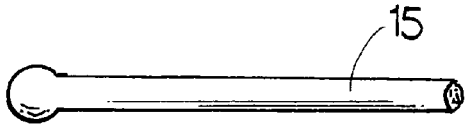
FIG. 32 is a front view of a paddle tilting assembly stud showing the cylindrical shaft and spherical top.
Figure 31:
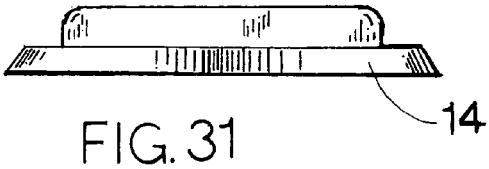
FIG. 31 is a side view of FIG. 29 and FIG. 30.
Figure 33:
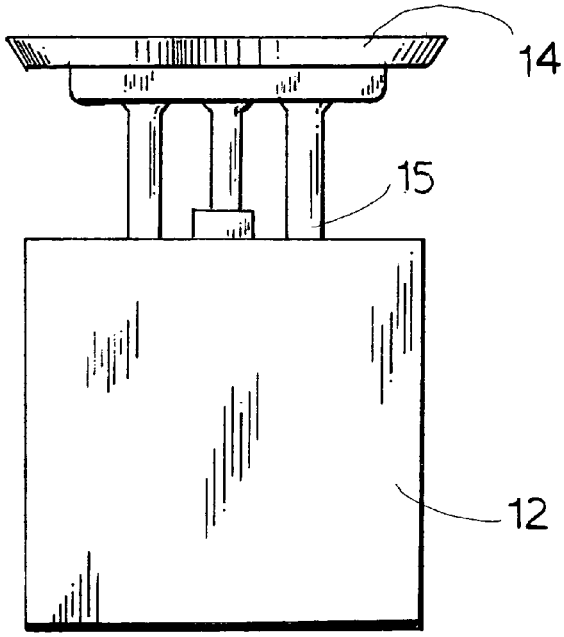
FIG. 33 is a front view of a complete paddle tilting assembly, showing the tops of the paddle tilting assembly studs of FIG. 32 inserted into the sockets of the paddle tilting assembly pad of FIG. 29 and the shafts of the studs inserted into the holes of the paddle tilting assembly support of FIG. 25. The shaft of the center stud is fastened to the paddle tilting assembly support of FIG. 25 while the shafts of the other 2 paddle tilting assembly studs are free to slide up and down in the holes of the paddle tilting assembly support.
Figure 34:
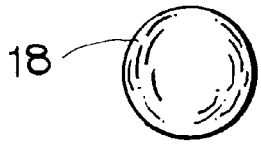
FIG. 34 is a side view of the spherical projectile.
Figure 35:
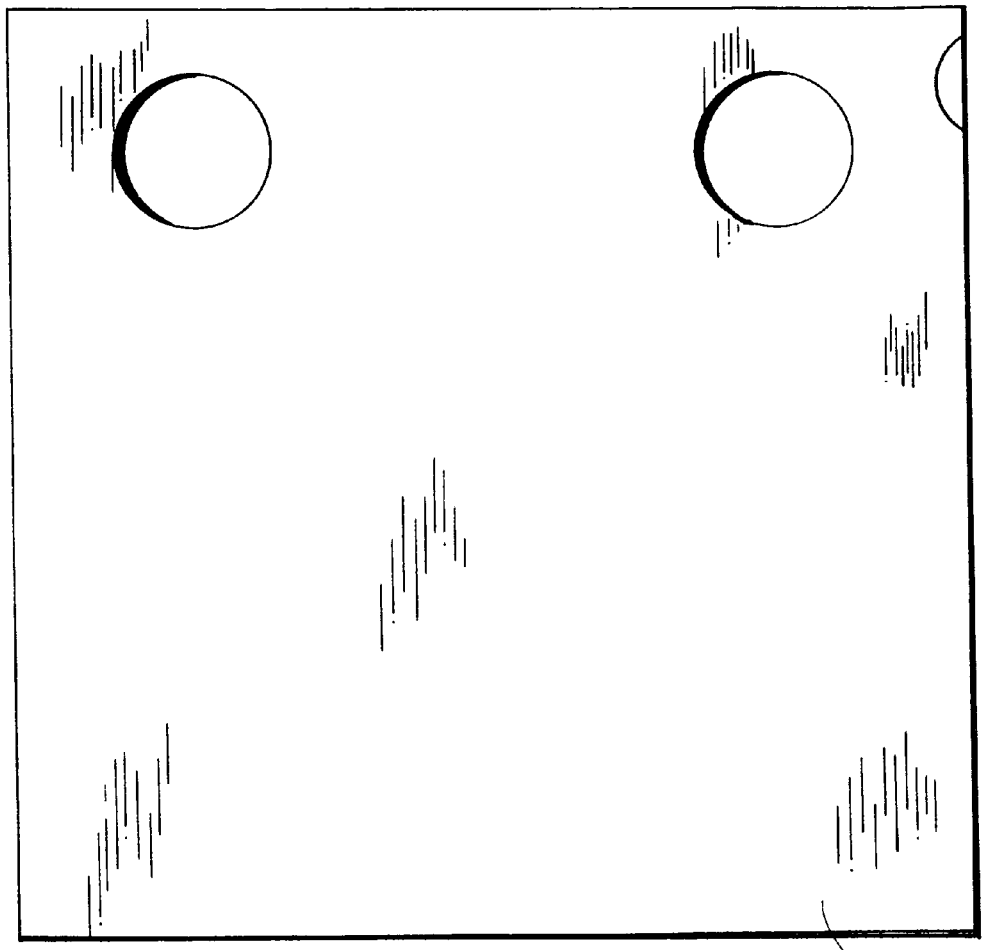
FIG. 35 is a top view of a paddle showing the 2 holes and the notch along the edge.
Figure 36:
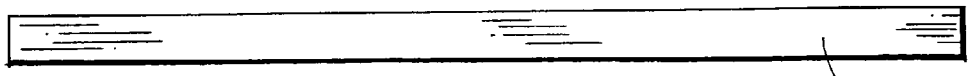
FIG. 36 is a side view of FIG. 35.
Figure 37:
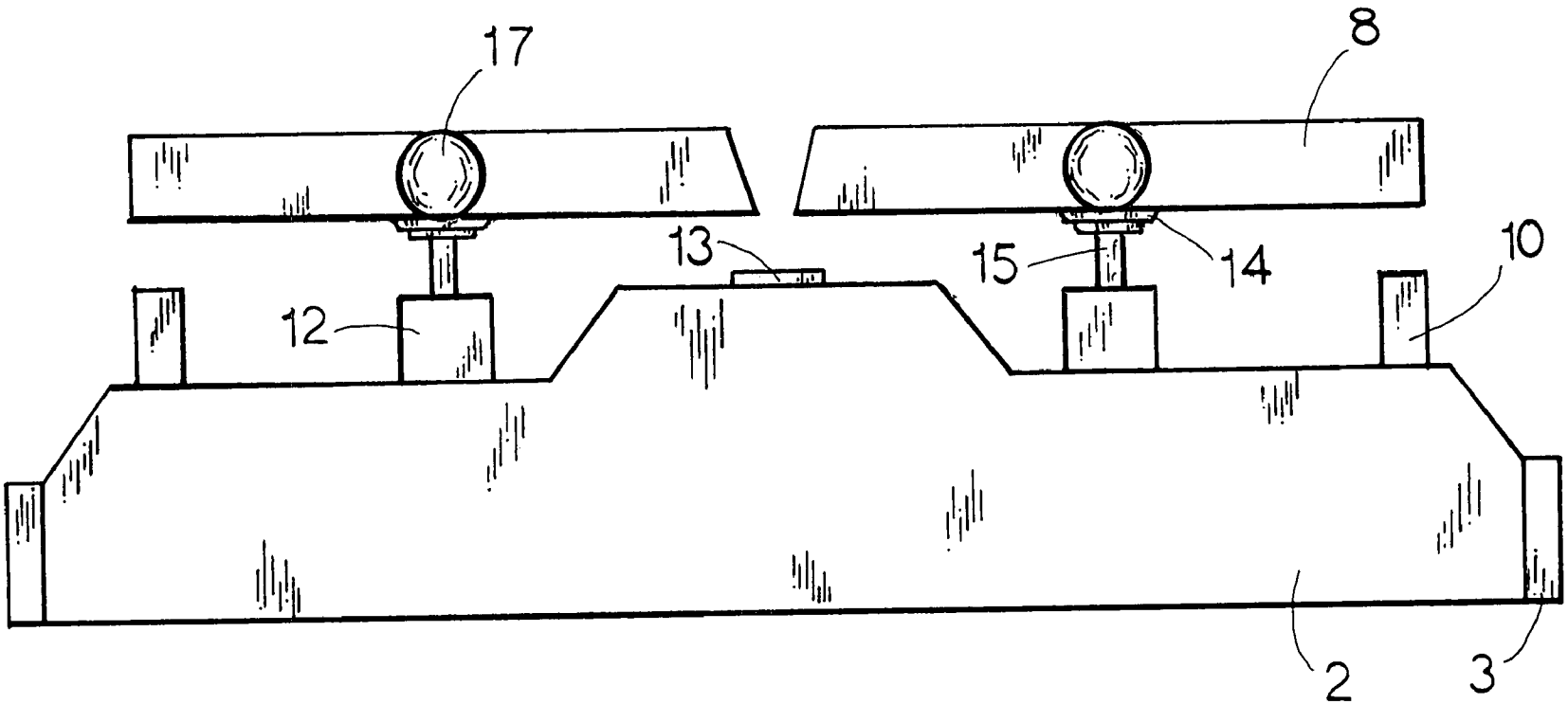
FIG. 37 is a 2-dimensional side view of the complete tilting projectile game showing the base end rails of FIG. 5, the corner stops of FIG. 13 and the middle stop of FIG. 11 connected to the base side rail of F*ig*. 3. The complete paddle tilting assembly of FIG. 33 is shown below the paddle rails of FIG. 9, which are shown with the control knobs of reference character 17 attached.
Figure 38:
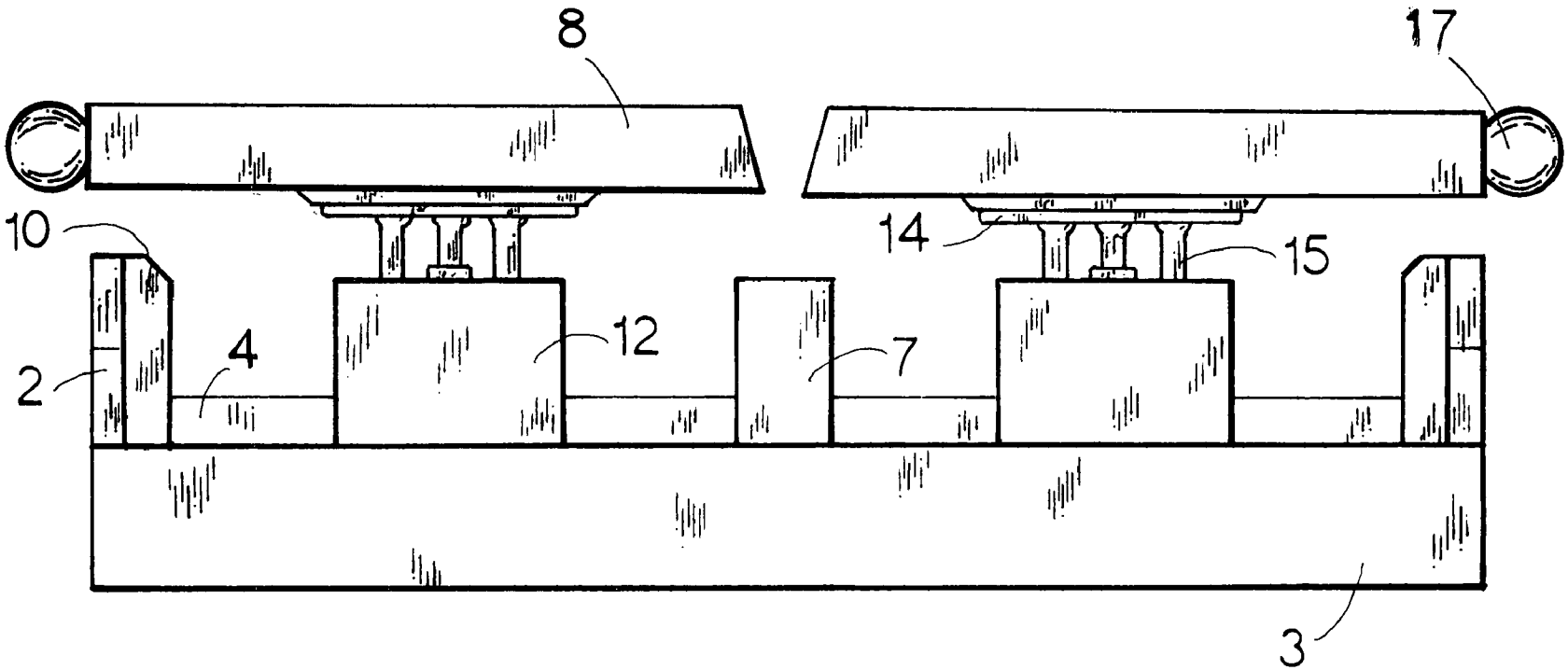
FIG. 38 is a 2-dimensional end view of FIG. 37. In that view the middle stop of FIG. 14 and the base ramp of FIG. 7 are visible.
Figure 39:
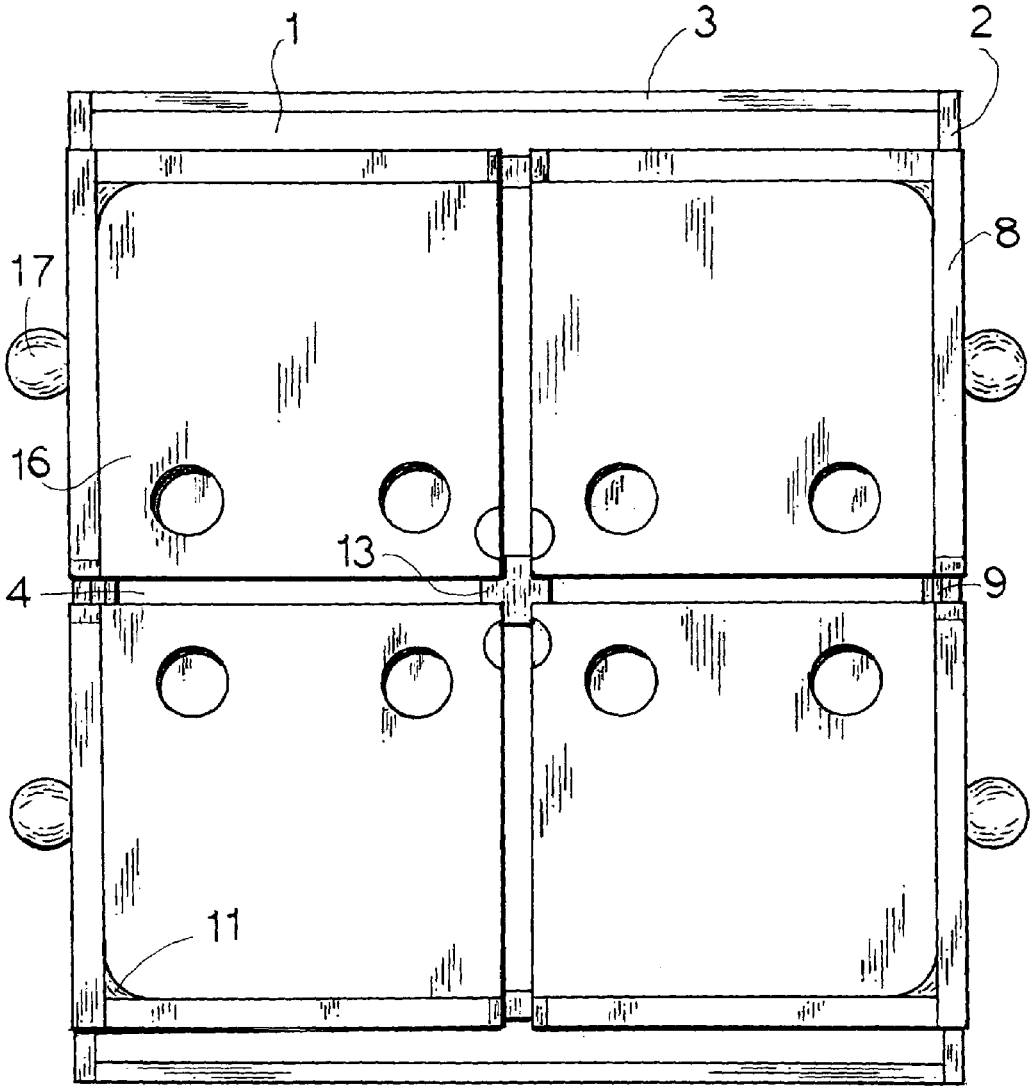
FIG. 39 is a 2-dimensional top view of FIG. 37 and FIG. 38 showing the paddle rails of FIG. 9, with control knobs of reference character 17 attached, connected to the paddles of FIG. 35 and the paddle rail curves of FIG. 20. The middle stops of FIG. 11, the center stop of FIG. 26, the base side rails of FIG. 3 and the base end rails of FIG. 5 are shown attached to the base of FIG. 1.

Referring to FIG. 38, a tilting projectile game, playable by 1 to 4 people, and consisting of: a base 1, 4 paddles 16, 4 paddle tilting assemblies and a spherical projectile 18. FIG. 33 shows a complete paddle tilting assembly which is composed of the paddle tilting assembly pad 14, 3 of the paddle tilting assembly studs 15 and the paddle tilting assembly support 12. The pads have 3 inline spherical shaped sockets; the studs have a cylindrical shaft and a spherical top. The stud's spherical tops are pressed into the sockets of the pad and the shafts of the studs are inserted into the 3 inline vertical holes of the support. The shaft of the center stud is fastened to the support while the shafts of the other 2 studs are free to slide up and down inside the vertical holes of the support in a piston and cylinder fashion. When so assembled the pad is able to tilt and pivot a full 360 degrees around the spherical tops of the 3 studs but the pad can not turn on the studs. Therefore the longitudinal axis of the pad is always parallel to the longitudinal centerline of the support. The upper surface of the pads of the paddle tilting assembly are connected to the center of the underside of the paddles, with the longitudinal centerline of the pad lying along the longitudinal centerline of the paddle as shown in FIG. 37 and FIG. 38. The bottom surface of the supports of the paddle tilting assemblies are connected to the upper surface of the base 1, forming a rectangular 2×2 paddle array with a narrow gap separating the interior edges of the paddles as shown in FIG. 39. This arrangement allows each paddle to be individually tilted in every direction while preventing the paddles from touching each other. The paddle rails 8 are connected to 2 adjacent edges of the paddles as shown in FIG. 37, FIG. 38 and FIG. 39, forming a rail along the perimeter of the 2×2 paddle array. The rail is used both to control the movement of the spherical projectile and to prevent the projectile from falling off the exterior edges of the paddles. The paddle rail curve 11 is connected to the paddle rails and the paddle as shown in FIG. 39. That curve in the rail at the corner of each paddle allows the spherical projectile to roll smoothly along the entire rail of each paddle. The paddle rail control knobs 17 are attached to the paddle rails as shown in FIG. 37, FIG. 38 and FIG. 39. Each player holds the control knob of one or two paddles. By raising, lowering and/or turning the control knobs the player is able to control the movement of the paddle and the spherical projectile when it is on their paddles and they can cause the projectile to roll or jump to another paddle. Each paddle can be used individually to control the motion of the projectile or 2 paddles can be used in unison to maneuver the projectile when the projectile is in contact with both paddles. In addition, the notch in the paddle shown in FIG. 35 can be used to hold, lift and lower the projectile when the side by side notches of 2 paddles are maneuvered in unison. The middle stops 9, corner stops 10 and the center stop 13 are all attached to the upper surface of the base 1 in the positions shown in FIG. 37, FIG. 38 and FIG. 39. Those stops act to limit the vertical motion of the paddles. Extensions attached to the corner stops may be used to further limit the motion of the paddles. The 2 ramps 4, with the rear bumpers 7, corner bumpers 6 and center bumper 5 connected as shown in FIG. 7 and FIG. 8, are attached to the upper surface of the base 1 as shown in FIG. 38. The leading edges of the 2 ramps are positioned on the 2 supports of the base shown in FIG. 1 and FIG. 2 and are in contact with each other, forming a peak above the latitudinal centerline of the base. From there the ramps slope downward towards the ends of the base. The resultant slant of the ramps causes the spherical projectile to roll down to the base end rail 3 whenever the projectile drops below the paddles. The rear, corner and center bumpers guide the projectile away from the stops and the support of the paddle tilting assembly to ensure that the projectile reaches the base end rail. The base side rails 2 and the base end rails are attached to the base 1 as shown in FIG. 37, FIG. 38 and FIG. 39. Those base rails act to prevent the spherical projectile from falling off the base after the projectile has dropped under the paddles.

The tilting projectile game described above allows a player to have precise control of the motion of the paddles they are operating and of the spherical projectile when the projectile is on their paddle. By raising, lowering and/or turning the control knob of the paddle, the player controls the velocity of the projectile and they can cause the projectile to roll or jump from one paddle to another. The object of the tilting projectile game is for opposing players to cause the spherical projectile to drop under their opponent's paddle, either by having the projectile fall through a hole in the opponent's paddle or pass under an edge of the opponent's paddle. A player wins the game when that object is accomplished a given number of times.

This paragraph describes the construction of the invention. The paddle rails 8 are glued onto 2 adjacent edges the paddles 16, as shown in FIG. 39. The paddle rail curves 11 and the paddle control knobs 17 are glued onto the paddle rails as shown in FIG. 39. The paddle tilting assembly pad 14 glued to the middle of the underside of the paddle, with the longitudinal centerline of the pad lying along the longitudinal centerline of the paddle. The spherical tops of the 3 tilting paddle assembly studs 15 are pressed into the spherical shaped sockets of the pads. The cylindrical shafts of the studs are inserted into the 3 vertical holes in the paddle tilting assembly support 12. The shaft of the center stud is fastened to the support. The base side rails 2 and base end rails 3 are glued to the edges of the base 1 as shown in FIG. 37, FIG. 38, and FIG. 39. The base middle stops 9, base corner stops 10 and base center stop 13 are glued onto the base as shown in FIG. 37, FIG. 38 and FIG. 39. The rear bumpers 7, corner bumpers 6 and center bumpers 5 are glued onto the base ramp 4 as shown in FIG. 7 and FIG. 8. The base ramps are then glued onto the base, with the leading edges of the 2 ramps centered on the 2 supports of the base shown in FIG. 1 and FIG. 2, forming a peak above the latitudinal centerline of the base. The paddle tilting assemble supports are lowered through the rectangular openings in the base ramps and then attached to the base with screws.

While there has been shown and described a preferred embodiment of the tilting projectile game of this invention, it is understood that changes in structure, materials, sizes and shapes can be made by those skilled in the art without departing from the invention. The invention is defined in the following claims.

I claim:

1. A tilting projectile game, playable by 1 to 4 people, comprising: 4 paddles, a base, 4 paddle tilting assemblies that; connect the paddles to the base in a closely grouped 2×2 array in which the inner edges of side by side paddles are parallel or approximately parallel, and allow the paddles to be individually tilted in every direction while preventing the paddles from touching each other, and one or more spherical projectiles.

2. The tilting projectile game of claim 1 wherein said paddles each have: a rail along the 2 adjacent edges which are on the outside of the said 2×2 array, a control knob attached to each rail, 1 or more holes which are large enough for the spherical projectile(s) to pass through and a notch near one corner which, when the side by side notches of 2 paddles are maneuvered in unison, can be utilized to hold and/or move the spherical projectile.

3. The tilting projectile game of claim 1 wherein said paddle tilting assemblies consist of a pad which is connected to said paddle, 2 or more studs and a support block, in which the upper ends of the studs are connected to the pad in a ball and socket arrangement, with the pad providing the sockets and the studs the balls, the shafts of the studs are inserted into vertical holes of the support block with one stud shaft being fastened to the support block while the shaft(s) of the other stud(s) are free to move up and down in the vertical holes of the support block in a piston and cylinder fashion.

4. The tilting projectile game of claim 1 wherein said base has rails along the edges, a slopping upper surface which guides the spherical projectile(s) to retrieval areas at the ends of the base after the spherical projectile drops below the paddles and a number of vertical stops located below the paddles, which are attached to the upper surface of the base and act to limit the vertical motion of the paddles and in which extensions of the said stops may be used to hold the paddles in a fixed position.

5. The tilting projectile game of claim 1 wherein the said control knob(s) is used to control the motion of the paddle(s) and of the spherical projectile(s) when it is on the paddle(s) and can cause the projectile to roll and/or jump to another paddle(s).

* * * * *